US009640114B2

(12) United States Patent
Nebon et al.

(10) Patent No.: US 9,640,114 B2
(45) Date of Patent: May 2, 2017

(54) DEVICE COMPRISING A MATRIX OF ACTIVE OLED PIXELS WITH BRIGHTNESS ADJUSTMENT, AND CORRESPONDING METHOD

(71) Applicant: STMicroelectronics International N.V., Amsterdam (NL)

(72) Inventors: Jerome Nebon, Seyssins (FR); Christophe Forel, Grenoble (FR)

(73) Assignee: STMicroelectronics International N.V., Schiphol (NL)

( * ) Notice: Subject to any disclaimer, the term of this patent is extended or adjusted under 35 U.S.C. 154(b) by 173 days.

(21) Appl. No.: 14/725,112

(22) Filed: May 29, 2015

(65) Prior Publication Data

US 2015/0371588 A1 Dec. 24, 2015

(30) Foreign Application Priority Data

Jun. 19, 2014 (FR) ..... 14 55648

(51) Int. Cl.

| | |
|---|---|
| ***G09G 3/3258*** | (2016.01) |
| ***G09G 3/20*** | (2006.01) |
| ***G09G 3/3291*** | (2016.01) |
| ***G09G 3/3233*** | (2016.01) |
| ***G09G 3/3266*** | (2016.01) |

(52) U.S. Cl.

CPC ..... *G09G 3/3258* (2013.01); *G09G 3/2003* (2013.01); *G09G 3/2081* (2013.01); *G09G 3/3233* (2013.01); *G09G 3/3266* (2013.01); *G09G 3/3291* (2013.01); *G09G 2300/0866* (2013.01); *G09G 2320/0233* (2013.01); *G09G 2320/0242* (2013.01); *G09G 2320/0626* (2013.01); *G09G 2330/028* (2013.01)

(58) Field of Classification Search

None

See application file for complete search history.

(56) References Cited

U.S. PATENT DOCUMENTS

| | | | | |
|---|---|---|---|---|
| 2003/0107565 | A1* | 6/2003 | Libsch | G09G 3/3233 345/211 |
| 2004/0041525 | A1 | 3/2004 | Park et al. | |
| 2004/0196223 | A1* | 10/2004 | Kwon | G09G 3/3233 345/82 |
| 2006/0164345 | A1 | 7/2006 | Sarma et al. | |

(Continued)

FOREIGN PATENT DOCUMENTS

| | | | |
|---|---|---|---|
| EP | 1061497 | A1 | 12/2000 |
| WO | WO-2012049000 | A1 | 4/2012 |

OTHER PUBLICATIONS

INPI Search Report and Written Opinion for FR 1455648 dated Aug. 28, 2014 (7 pages).

*Primary Examiner* — Chad Dicke

(74) *Attorney, Agent, or Firm* — Gardere Wynne Sewell LLP

(57) ABSTRACT

A device includes a matrix of active pixels. Each active pixel includes an OLED and a control circuit configured to refresh the active pixel and including at least one transistor having a first conduction terminal coupled to a supply line and a second conduction terminal coupled to the OLED. Supply circuitry is configured to apply a supply voltage to the supply line of each active pixel during the refreshing of the active pixel and for a time period less than a duration of the refreshing of the active pixel.

8 Claims, 3 Drawing Sheets

(56) References Cited

U.S. PATENT DOCUMENTS

| | | | | |
|---|---|---|---|---|
| 2014/0285408 | A1* | 9/2014 | Yumoto | G09G 3/3233 345/76 |
| 2015/0371588 | A1* | 12/2015 | Nebon | G09G 3/3258 345/691 |

* cited by examiner

DEVICE COMPRISING A MATRIX OF ACTIVE OLED PIXELS WITH BRIGHTNESS ADJUSTMENT, AND CORRESPONDING METHOD

RELATED APPLICATION

This application claims the benefit and priority of French Patent Application No. 1455648, filed Jun. 19, 2014, titled DEVICE COMPRISING AN OLED ACTIVE MATRIX WITH DIMMING, AND CORRESPONDING METHOD, the contents of which are hereby incorporated by reference in their entirety.

TECHNICAL FIELD

This disclosure relates to devices equipped with matrices of active OLED pixels, and more precisely to circuits controlling the OLEDs of these pixel matrices.

BACKGROUND

Devices are known in which matrices of organic light emitting diodes (OLEDs) are controlled by control circuits that have transistors. In such devices, anodes of OLEDs can be coupled to a source of a transistor which supplies power to the OLED, and cathodes of the OLEDs may be coupled to a negative potential.

To adjust the total brightness emitted by the matrix of the OLED pixels and to obtain a dimming effect, provision has been made for varying this negative potential to which the cathodes of the OLEDs are coupled.

This being the case, OLEDs of different colors can react differently to this voltage variation at their cathodes. Due to this fact, variations of the cathode voltage can be accompanied by a loss of quality of the displayed colors.

Therefore, further development in the field of OLEDs and control circuits therefor are desirable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to a mode of implementation and an embodiment, provision is made for adjusting the brightness of OLEDs while reducing the loss of quality of the displayed colors.

According to an aspect, provision is made for a device including a matrix of active pixels, with each active pixel including an OLED and a control circuit intended to refresh the pixel. The control circuit includes at least one NMOS transistor having its drain coupled to a supply line, and having its source coupled to an anode of the OLED.

According to a general feature of this aspect, the device includes supply means or circuitry configured to apply a supply voltage to the supply line of each active pixel from a start of a refreshing of the pixel and for a finite time period shorter than a refresh period of the pixel.

To adjust the brightness, the voltage to the cathode of the OLEDs of the active pixels of the matrix is not varied. It is thus possible to make the OLEDs operate under nominal voltage conditions, and therefore produce the desired color.

To obtain an adjustment of the brightness, the inventors have observed that it is possible to discontinuously supply power to the drains of the NMOS transistors coupled by their sources to the OLEDs. The human eye observing the pixel matrix perceives a drop in luminosity which depends on the time period during which the OLED emits light.

The refreshing of the pixel matrix depends on a refresh frequency that those skilled in the art will know how to define. At each refreshing, a voltage is applied to the gate of the NMOS transistor which then maintains this voltage, for example by means of its MOS capacity.

By choosing a time period shorter than the period between refreshes, an adjustment of the brightness visible to the human eye is obtained, with good color production being preserved.

The active pixels of the matrix can be organized into rows and columns. The control circuits of the active pixels of a given row are able to be coupled to means or circuitry configured to apply to each control circuit of these active pixels a row selection voltage during the refreshing of the active pixels of the row. The active pixels of the row are linked by their control circuit to a same supply line, and the supply means or circuitry are further configured to apply a supply voltage to the supply line of each active pixel of the row for a finite time period from the moment of application of the row selection voltage.

Thus, the power supply of the NMOS transistor is synchronized with the selection of the row.

When the rows are successively powered, a refresh sequence is obtained that is analogous to the "rolling shutter" phenomenon which is suitable for displaying rapidly changing images.

The supply means or circuitry can include, for each row, a SR flip-flop with an input for receiving a row selection voltage and an input for receiving a voltage intended to stop the supply of a row.

The supply means or circuitry can be configured to apply a supply voltage to the supply line of each active pixel for a time period dependent on the duration of the successive selection of a number N of rows of the matrix.

According to another aspect, provision is made for a method for controlling a matrix of active pixels, with each active pixel including an OLED and a control circuit intended to refresh the pixel. The control circuit includes at least one NMOS transistor with its drain coupled to an electrical supply line, and its source coupled to the anode of the OLED.

According to a general feature of this aspect, a supply voltage is applied to the supply line of each active pixel from the start of the refreshing of the active pixel and for a finite time period shorter than the refresh period of the active pixel.

The active pixels of the matrix can be organized into rows and columns, and a row selection voltage can be applied to each control circuit of the active pixels of a same row during the refreshing of the active pixels of that row. The active pixels of the same row are linked by their control circuit to the same supply line, and a supply voltage can also be applied to the supply line of each active pixel of the same row for a finite time period from the instant of application of the row selection voltage.

A supply voltage can be applied to the supply line of each active pixel for a time period dependent on the duration of the successive selection of a number N of rows of the matrix.

BRIEF DESCRIPTION OF THE DRAWINGS

Other advantages and features will become apparent on consulting the detailed description of modes of implementation and embodiment, taken to be non-limiting examples and illustrated by the appended drawings in which.

DETAILED DESCRIPTION

Figure 1:
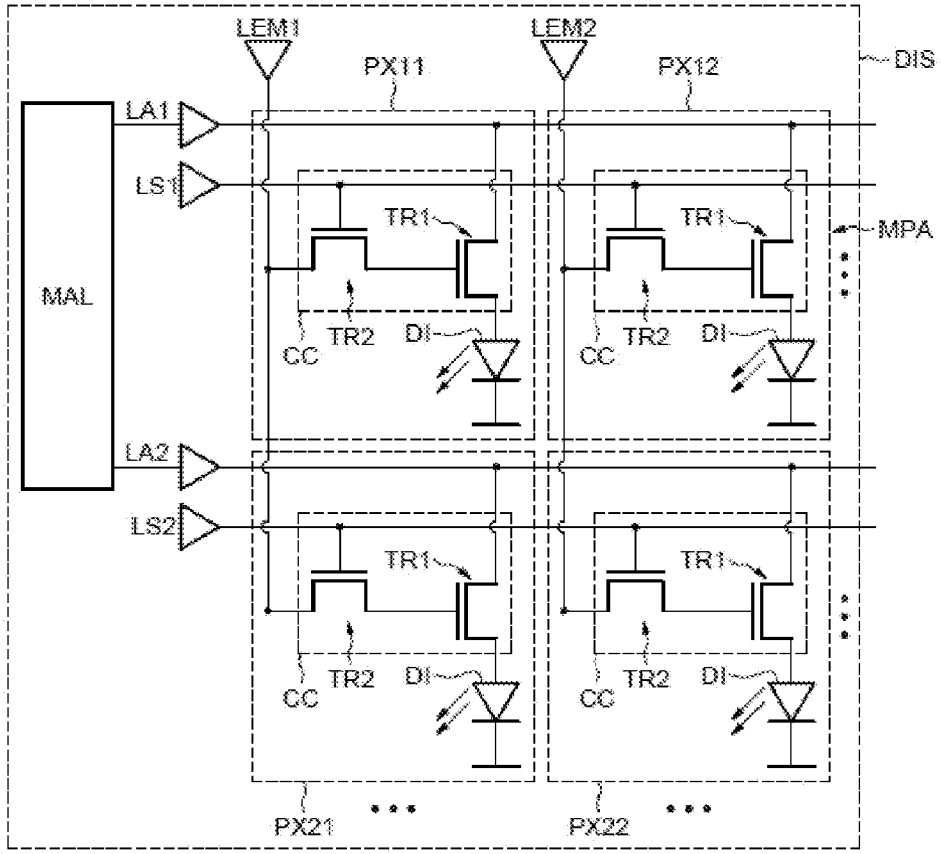
FIG. 1 is a diagram of a device according to an embodiment of this disclosure.

One or more embodiments of the present disclosure will be described below. These described embodiments are only examples of the presently disclosed techniques. Additionally, in an effort to provide a concise description, all features of an actual implementation may not be described in the specification.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Like reference numbers in the drawing figures refer to like elements throughout.

In FIG. 1, a device DIS comprising a matrix MPA of active pixels is represented in part and schematically.

Four active pixels are represented in the figure as follows: the pixel PX11 is located on the top left-hand side, the pixel PX12 is located on the right of the pixel PX11, the pixel PX21 is located below the pixel PX11, and the pixel PX22 is located below the pixel PX12 and on the right of the pixel PX21.

The matrix MPA of active pixels includes other pixels which define rows and columns, within which the pixel referred to as PXij corresponds to the pixel located on the row of index i and on the column of index j.

Each active pixel of the matrix MPA comprises an OLED, referred to as DI in the figure, and a control circuit CC. The control circuit CC makes it possible to refresh the pixel, i.e. to maintain a voltage across the terminals of the OLED DI of the active pixel PXij to obtain an emission of light.

For this purpose each control circuit CC includes an NMOS transistor TR1, the source of which is coupled to the anode of the diode DI of the active pixel.

Whereas in the prior art the drain of the NMOS transistor TR1 is coupled to a common supply line for the NMOS transistors TR1 of each active pixel of the matrix, here, the drains of the NMOS transistors TR1 of the same row are coupled to a common electrical supply line LAi (i indicating the number of the row), and the electrical supply lines LAi are mutually independent.

Also, while in the prior art the supply line common to the drains is intended to receive a continuous supply voltage, here, each row is intended to receive a supply voltage for a finite time period.

The device DIS includes supply means or circuitry MAL configured to apply a supply voltage to each supply line LAi from the start of the refreshing of the pixels supplied by this line LAi and for a finite time period shorter than the refresh period of these pixels.

Each control circuit CC also includes an NMOS transistor TR2 with its drain coupled to the gate of the NMOS transistor TR1, which is in turn coupled to the diode DI. The gate of the NMOS transistors TR2 of the same row of the matrix are coupled to a row selection line LSi (with i indicating the number of the row) intended to receive a row selection voltage during the refreshing of the pixels of the row. This row selection voltage is delivered by means or circuitry configured to apply a row selection voltage to each control circuit of the pixels of the same row during the refreshing of the pixels of that row. The sources of the NMOS transistors TR2 of the same column are coupled to the same sampling and maintenance line LEMj (with j indicating the number of the column).

Figure 2:
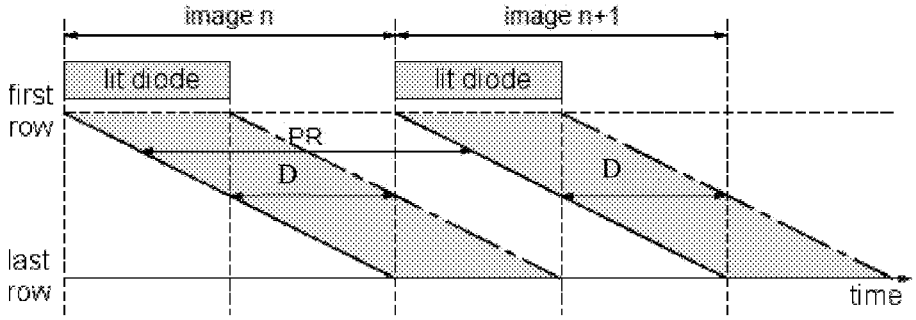
FIG. 2 illustrates, for two successive images, the moments of the start and the end of the powering of the supply lines of a matrix of active pixels according to an embodiment of this disclosure.

FIG. 2 illustrates, for two successive images n and n+1, the moments of the start and the end of the powering of the supply lines LAi of a matrix of active pixels.

In this figure, the bold line corresponds to the moments of the start of the application of a supply voltage by the supply means or circuitry MAL to each supply line LAi. As can be seen in this figure, the supply lines are successively powered up for a time period DL. The powering-up is represented by the shaded parts of the figure. The powering-up here corresponds to the start of the refreshing of the pixel.

After a time period D, the supply of the supply lines LAi is stopped (broken line). A time period D can be chosen as a function of a desired brightness, and the time period D is shorter than the time period PR of the period between two refreshes of the pixel.

Figure 3:
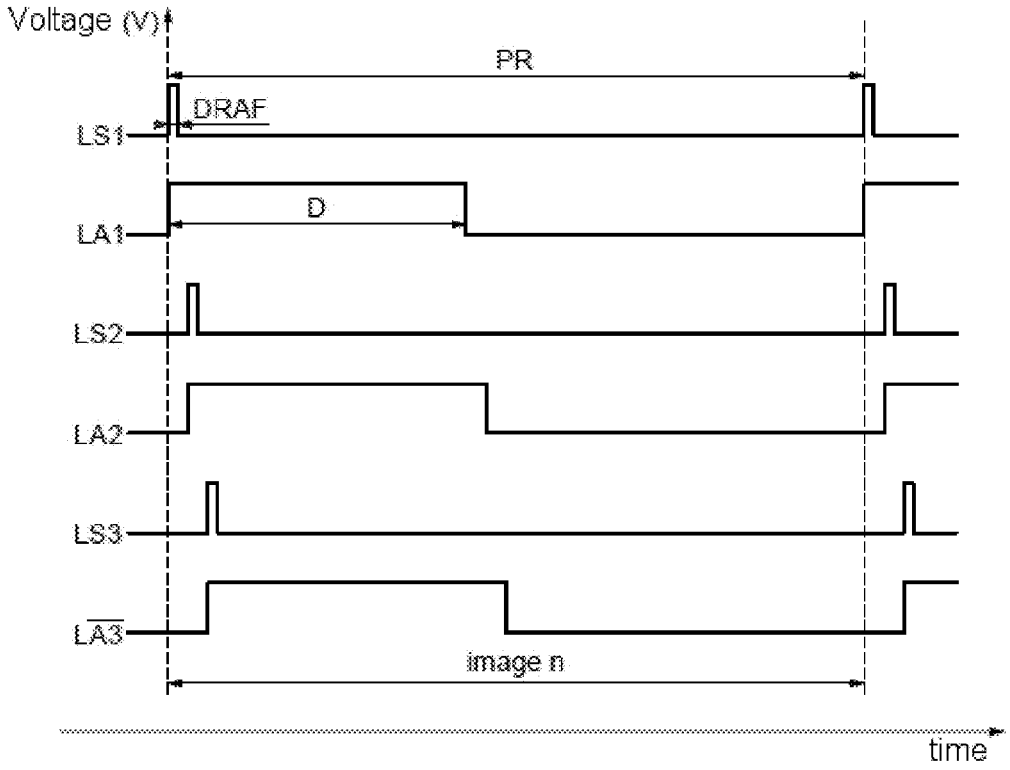
FIG. 3 is a timing diagram representing the voltage levels of the supply lines and the row selection lines of several rows of a device according to an embodiment of this disclosure.

FIG. 3 is a timing diagram representing the voltage levels of the supply lines LAi and the row selection lines LSi of the rows 1 to 3 of the matrix MPA of active pixels.

The refreshing of a row is implemented by applying a row selection voltage to the supply line LSi of a row of active pixels for a finite time period DRAF. When the time period DRAF has elapsed, during which a row selection voltage is applied, the following row is selected. When the row is selected, the voltage applied by the sampling and maintenance line LEMj is transmitted to the OLED DI and it is maintained.

The moment corresponding to the application of a selection voltage is also the instant corresponding to the application of a supply voltage to the line LAi associated with the selection line.

Note that the time period D can be chosen in such a way that the successive selection of a number N of rows of the matrix is accomplished. The time period D is then equal to N times the time period DRAF.

Figure 4:
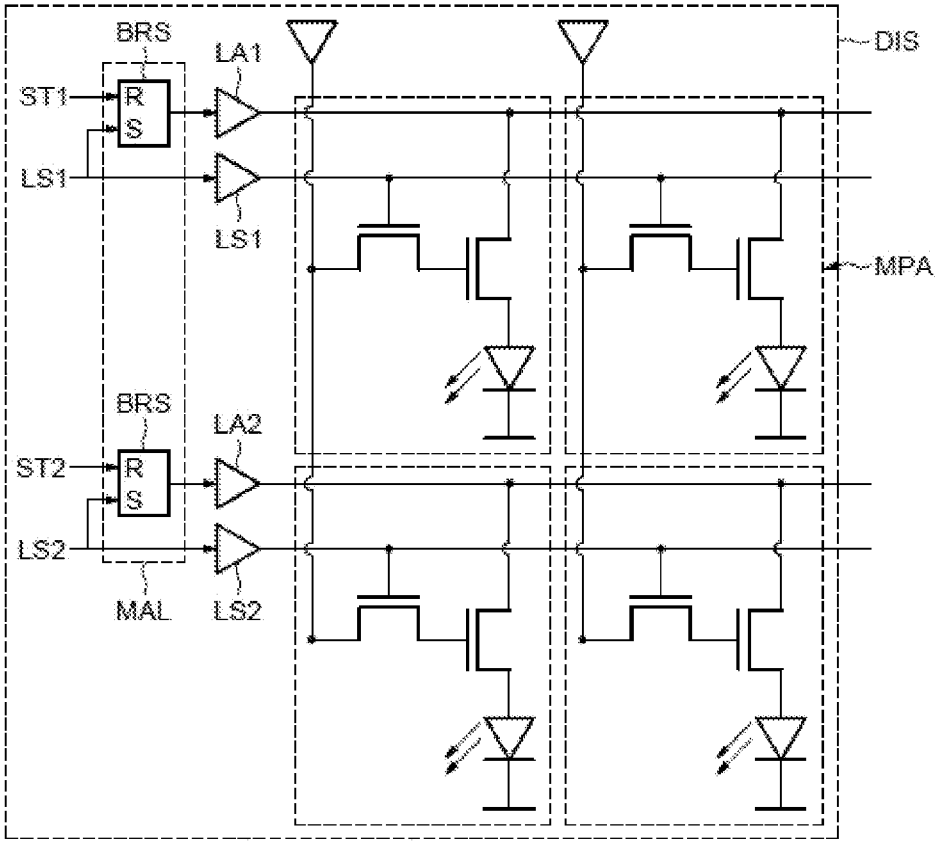
FIG. 4 is a more detailed diagram of the device in FIG. 1.

In FIG. 4, the device DIS is represented with the supply means or circuitry MAL represented in more detail.

The supply means or circuitry include, for each supply line, LAi, an RS flip-flop referred to as BRS with an input to receive the row selection voltage, which is linked to the row selection line LSi, and an input to receive a voltage intended to stop the supply of a row coupled to a supply stopping line STi.

Figure 5:
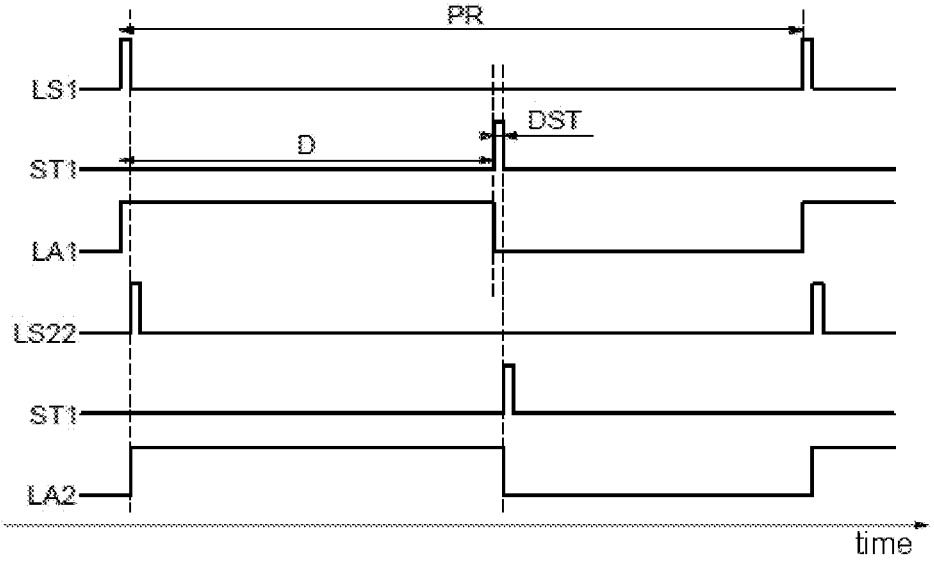
FIG. 5 is another timing diagram representing the voltage levels of the supply lines and the row selection lines of several rows of a device according to an embodiment of this disclosure.

FIG. 5 is a timing diagram that illustrates the use of the supply stopping signal on the supply stopping lines ST1 and ST2.

After a time period D corresponding to the application of a supply voltage to a line LAi, a stopping signal is applied to the line STi, which resets the flip-flop BRS of the line. The stopping signal is applied for a time period DST, and it is at the rising edge of this signal that the supply to the line LAi is stopped.

Therefore, this makes it possible to adjust the brightness and effectuate "dimming" while preserving good colors.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. A device, comprising:

a matrix of active pixels organized into rows and columns, each active pixel comprising:

a supply line, an OLED, a control circuit configured to refresh the active pixel and including a first transistor having a first conduction terminal coupled to the supply line, a second conduction terminal coupled to the OLED, and a control terminal;

a second transistor having a first conduction terminal coupled to control the first transistor via the control terminal of the first transistor, a second conduction terminal coupled to receive a sampling and maintenance line, and a control terminal;

supply circuitry comprising, for each row, a flip-flop having a first input receiving a row selection voltage and a second input receiving a supply stopping voltage configured to stop supply of a supply voltage to first conduction terminals of first transistors of active pixels of that row;

wherein the supply circuitry is configured to apply the row selection voltage to the control terminal of each second transistor of its respective row during the refreshing of the active pixels thereof;

wherein the flip-flop is configured to apply the supply voltage to the supply line of each active pixel of its respective row from a moment of application of the row selection voltage and for a time period dependent on an elapsed time required for a given number of rows of the matrix to successively receive the row selection voltage at control terminals of their second transistors.

2. A device, comprising:

a matrix of active pixels organized into rows and columns, each active pixel comprising:

a supply line, a row selection line, a sampling and maintenance line, an OLED having an anode, a first NMOS transistor having a drain coupled to receive a supply voltage from the supply line, a source coupled to the anode of the OLED, and a gate, a second NMOS transistor having a source coupled to the sampling and maintenance line, a drain coupled to the gate of the first NMOS transistor, and a gate coupled to the row selection line, wherein each row of active pixels includes a RS flip flop having an R input coupled to a supply stopping voltage configured to stop supply of the supply voltage to drains of first NMOS transistors of active pixels of that row, a S input coupled to the row selection line, and an output coupled to the supply line.

3. A method, comprising:

refreshing each active OLED pixel of a matrix during a refresh period based upon a row selection voltage; and applying a supply voltage to a supply line of each of the active OLED pixels of the matrix during the refreshing and for a time period shorter than the refresh period using a RS flip-flop having an R input coupled to a supply stopping voltage configured to stop supply of the supply voltage to active OLED pixels of a row of the active OLED pixels of the matrix, an S input coupled to the row selection voltage, and an output coupled to the supply line.

4. The method according to claim 3, wherein the active OLED pixels of the matrix are organized into rows and columns, and further comprising applying the row selection voltage to control circuits of the active OLED pixels of a same row during the refresh period; and wherein the supply voltage is applied to the supply line of each active OLED pixel of a same row starting from the application of the row selection voltage.

5. The method according to claim 4, wherein the time period is dependent on an elapsed time required for a given number of rows of the matrix to successively receive and be selected by the row selection voltage.

6. A method for controlling a matrix of active OLED pixels organized into rows and columns, each active OLED pixel comprising an OLED and a control circuit configured to refresh the active OLED pixel and including a first NMOS transistor having a drain coupled to receive a supply voltage from a supply line and a source coupled to an anode of the OLED, a second NMOS transistor having a source coupled to a gate of the first NMOS transistor and a gate coupled to a row selection voltage, and a flip-flop having a first input receiving the row selection voltage, a second input receiving a supply stopping voltage configured to stop supply of the supply voltage to drains of first NMOS transistors of active OLED pixels of a row of active OLED pixels, and an output coupled to the supply line, the method comprising:

using the flip-flop to apply a supply voltage to the supply line of each active OLED pixel starting from refreshing of that active pixel and for a finite time period shorter than a refresh period of that pixel.

7. A method according to claim 6, further comprising applying the row selection voltage to gates of second NMOS transistors of the active OLED pixels of a same row during the refresh period; and the supply voltage is applied to the supply line of each active OLED pixel of a same row starting from the application of the row selection voltage.

8. The method according to claim 6, wherein the finite time period is dependent on an elapsed time required for a given number of rows of the matrix to successively receive the row selection voltage at gates of their second NMOS transistors.

* * * * *